US011360433B2

(12) United States Patent
Rochat

(10) Patent No.: US 11,360,433 B2
(45) Date of Patent: Jun. 14, 2022

(54) TIMEPIECE DISPLAY CORRECTION MECHANISM

(71) Applicant: Montres Breguet S.A., L'Abbaye (CH)

(72) Inventor: Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 560 days.

(21) Appl. No.: 16/291,002

(22) Filed: Mar. 4, 2019

(65) Prior Publication Data

US 2019/0294112 A1 Sep. 26, 2019

(30) Foreign Application Priority Data

Mar. 26, 2018 (EP) ..... 18163843

(51) Int. Cl.

| | |
|---|---|
| ***G04B 13/02*** | (2006.01) |
| ***G04B 19/24*** | (2006.01) |
| ***G04B 19/25*** | (2006.01) |
| ***G04B 19/253*** | (2006.01) |
| ***G04B 13/00*** | (2006.01) |

(52) U.S. Cl.

CPC ..... *G04B 19/25* (2013.01); *G04B 13/00* (2013.01); *G04B 13/02* (2013.01); *G04B 19/24* (2013.01); *G04B 19/2536* (2013.01)

(58) Field of Classification Search

CPC .... G04B 19/25; G04B 13/02; G04B 19/2536; G04B 19/24; G04B 13/00

See application file for complete search history.

(56) References Cited

U.S. PATENT DOCUMENTS

| | | | | |
|---|---|---|---|---|
| 3,019,595 A * | 2/1962 | Murrle | G04B 5/24 368/148 |
| 9,400,488 B2 * | 7/2016 | Marechal | G04B 11/028 |
| 9,454,133 B2 * | 9/2016 | Goeller | G04B 19/2576 |
| 9,851,695 B1 * | 12/2017 | Roth | G04B 19/283 |
| 10,261,471 B2 * | 4/2019 | Bertrand | G04B 11/00 |

(Continued)

FOREIGN PATENT DOCUMENTS

| | | |
|---|---|---|
| CH | 710 250 A2 | 4/2016 |
| CN | 203773235 U | 8/2014 |

(Continued)

OTHER PUBLICATIONS

EP 2503410 translation patents.google.com—2012.*

(Continued)

*Primary Examiner* — Sean Kayes

(74) *Attorney, Agent, or Firm* — Oblon, McClelland, Maier & Neustadt, L.L.P.

(57) ABSTRACT

A correction mechanism for a timepiece date display mechanism, arranged to change the angular position of a display wheel set comprised in such a date display mechanism, this correction mechanism includes, on the one hand, a control wheel set arranged to be controlled by user action and/or by a timepiece mechanism, and on the other hand, an output wheel set arranged to cooperate with such a display wheel set; this correction mechanism includes a free wheel mechanism which is arranged to disengage the output wheel set from the control wheel set in a first relative direction of rotation, and to engage the output wheel set with the control wheel set in a second relative direction of rotation opposite to the first relative direction of rotation.

13 Claims, 3 Drawing Sheets

(56) References Cited

U.S. PATENT DOCUMENTS

| | | | |
|---|---|---|---|
| 2012/0243381 | A1 | 9/2012 | Goeller et al. |
| 2014/0056112 | A1 | 2/2014 | Villaret |
| 2015/0331392 | A1 | 11/2015 | Ruefenacht et al. |
| 2017/0075307 | A1 | 3/2017 | Merino et al. |

FOREIGN PATENT DOCUMENTS

| | | | |
|---|---|---|---|
| CN | 106527094 | A | 3/2017 |
| CN | 207037340 | U | 2/2018 |
| EP | 2 503 410 | A2 | 9/2012 |
| EP | 2 701 014 | A1 | 2/2014 |
| EP | 2 945 026 | A1 | 11/2015 |

OTHER PUBLICATIONS

European Search Report dated Sep. 13, 2018 in European Application 18163843.8, filed on Mar. 26, 2018 ( with English translation of Categories of Cited Documents).

Combined Chinese Office Action and Search Report dated Aug. 7, 2020 in Patent Application No. 201910227765.1 (with English translation of Category of Cited Documents), 7 pages.

* cited by examiner

TIMEPIECE DISPLAY CORRECTION MECHANISM

CROSS-REFERENCE TO RELATED APPLICATION

This application claims priority to European Patent Application No. 18163843.8 filed on Mar. 26, 2018, the entire disclosure of which is hereby incorporated herein by reference.

FIELD OF THE INVENTION

The invention concerns a correction mechanism for a timepiece date display mechanism, arranged to change the angular position of a display wheel set comprised in a said date display mechanism; said correction mechanism includes, on the one hand, a control wheel set arranged to be controlled by user action and/or by a timepiece mechanism, and on the other hand, an output wheel set arranged to cooperate with a said display wheel set, said correction mechanism comprising a free wheel mechanism which is arranged to uncouple said output wheel set from said control wheel set in a first relative direction of rotation, and to couple said output wheel set to said control wheel set in a second relative direction of rotation opposite to said first relative direction of rotation.

The invention also concerns a date display mechanism comprising a display wheel set and such a correction mechanism.

The invention also concerns a timepiece comprising such a date display mechanism with such a correction mechanism.

The invention concerns the field of timepiece display mechanisms and more specifically date display mechanisms.

BACKGROUND OF THE INVENTION

Several systems exist for correcting a date display, which allow correction in one direction and disengagement in the other. There is a known disengaging lever system, wherein the mechanism of the system disengages during the reverse rotation to avoid driving the date disc. There is also a known friction system using an oblong hole, wherein the mechanism disengages through friction during the reverse rotation to avoid driving the date disc.

The levers are cumbersome and friction mechanisms use energy and are a cause of contamination in a watch.

European Patent Application No EP2503410A2 in the name of MONTRES BREGUET discloses a calendar mechanism comprising a 31-toothed wheel set arranged to control a date indicator, date drive means arranged to drive the 31-toothed wheel set, a 12-toothed wheel set arranged to control a month indicator, and a monthly drive means arranged to drive the 12-toothed wheel set at the end of each month, the 12-toothed wheel set being arranged to actuate the monthly drive means when changing from the end of one month to the first day of the following month, the calendar mechanism further including a manually actuated quick correction device, the quick correction device being able to move the 31-toothed wheel set forward in a single action until the date indicator changes to the following month by actuating the monthly drive means in passing. The quick correction device includes a rotating banking member kinematically connected to the 31-toothed wheel set, and a stop movable between an active position in which it intercepts the trajectory of the rotating banking member and an inactive position, and this quick correction device is arranged to move the stop into the active position and to move the 31-toothed wheel set forward in a single action until the stop stops the rotating banking member and immobilises the 31-toothed wheel set in an angular position corresponding to the indication of the first day of the month. European Patent No EP EP2701014 in the name of ROLEX discloses a lever including at least a first element for guiding the rotation of a first wheel set, at least one friction element intended to cooperate with an at least substantially cylindrical portion of the first wheel set, and at least one elastic element, intended to elastically return the at least one friction element to a state of cooperation with said first wheel set portion, particularly into contact with said first wheel set portion.

Swiss Patent Application No CH710250A2 discloses a device with coaxial disengaging wheels for a timepiece movement comprising an input wheel, an output wheel, a hub, and a jumper mechanism including a spring and positioning elements defining a certain number of discrete angular positions of the input wheel with respect to the output wheel around an axis of rotation. The positioning elements including hollow elements and protruding elements, the spring being configured to apply an elastic force pushing the protruding elements against the hollow elements to couple the wheels to each in rotation below an uncoupling torque. The protruding elements and the hollow elements extend in the axial direction and the spring is configured to apply an elastic force in the axial direction.

European Patent Application No EP2945026A1 in the name of ETA discloses a timepiece lever for transmitting a movement between, on the one hand a transmitter wheel set which carries a pivoting plate comprised in said lever and which is pivotally mounted about a first pivot axis, and on the other hand, at least one receiver wheel set external to said lever which includes, pivotally mounted about a second pivot axis remote from first pivot axis, at least one transmission wheel set carried by the pivoting plate, wherein the angular position of the second pivot axis of the transmission wheel set is variable relative to the first pivot axis. This transmitter wheel set permanently transmits its movement to the transmission wheel set which it drives in a pivoting motion about the second pivot axis, and the lever includes at least either a first friction connection between a first friction surface of the transmitter wheel set and a second friction surface of the pivoting plate, or a second friction connection between a third friction surface of the transmitter wheel set and a fourth friction surface of the pivoting plate.

SUMMARY OF THE INVENTION

The invention proposes to implement a compact correction mechanism to perform a quick correction with a one-directional mechanism and proposes to use a free wheel mechanism, as known in various general mechanical fields, such as bicycles, machine-tools, conveying devices or otherwise, in which locking usually occurs on rollers.

To this end, the invention concerns a correction mechanism for a timepiece date display mechanism, according to claim 1, to obtain both a space saving compared to the prior art, and a considerable simplification of the correction system, in particular for making the date correction system compact without using an additional wheel set.

The invention also concerns a date display mechanism comprising a display wheel set and such a correction mechanism.

The invention also concerns a timepiece comprising such a date display mechanism with such a correction mechanism.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
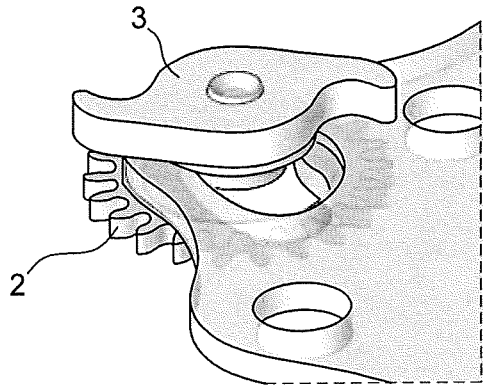
FIG. 1 represents a schematic, perspective view of a friction mechanism with an oblong hole of the prior art.
Figure 2:
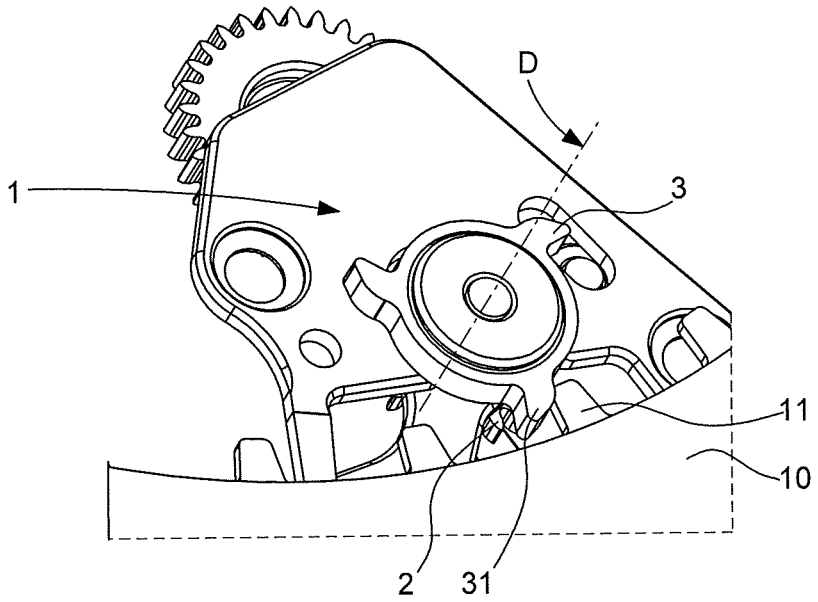
FIG. 2 represents, in a similar manner to FIG. 1, a part of a date mechanism provided with a correction mechanism according to the invention.
Figure 3:
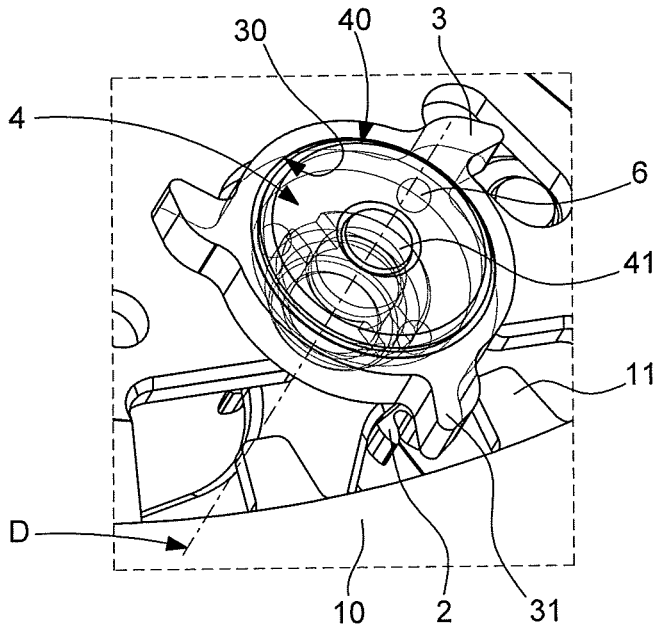
FIG. 3 is a detail of FIG. 2, showing the free wheel mechanism incorporated into correction mechanism.
Figure 4:
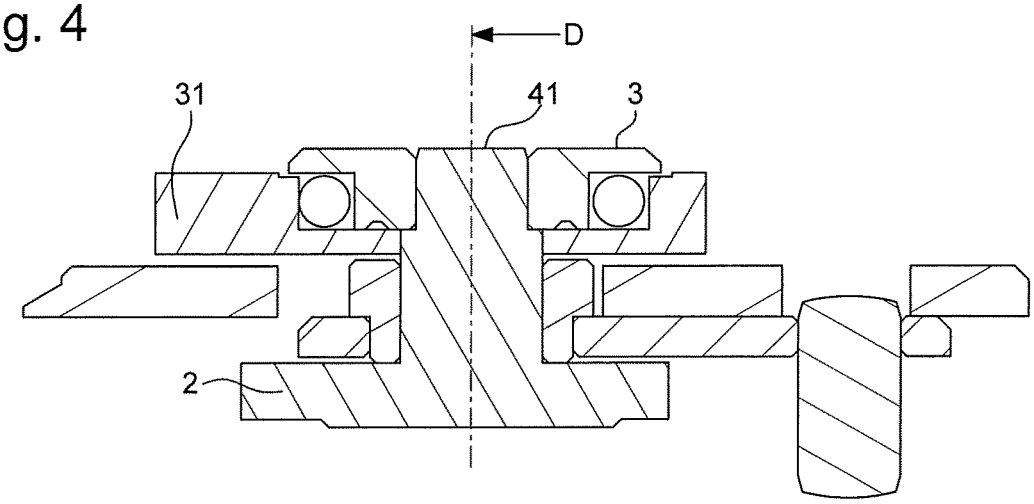
FIG. 4 is a cross-section of the correction mechanism passing through the pivot axis of the rotor of the free wheel mechanism.

The invention concerns a correction mechanism 1 for a timepiece date display mechanism 10, which includes a display wheel set 11.

Correction mechanism 1 is arranged to change the angular position of this display wheel set 11.

Correction mechanism 1 includes, on the one hand, a control wheel set 2, arranged to be controlled by user action and/or by a timepiece mechanism 100, and on the other hand, an output wheel set 3 arranged to cooperate with such a display wheel set 11.

This correction mechanism 1 includes a free wheel mechanism, which is arranged to disengage output wheel set 3 from control wheel set 2 in a first relative direction of rotation, and to engage output wheel set 3 with control wheel set 2 in a second relative direction of rotation opposite to the first relative direction of rotation.

According to the invention, this control wheel set 2, or respectively this output wheel set 3, is integral in rotation with a rotor 4. Output wheel set 3 or respectively control wheel set 2 includes a cavity 30, inside which rotor 4 can pivot. This rotor 4 and/or this cavity 30 includes at least a first chamber 5, 50, of variable radial cross-section relative to pivot axis D of rotor 4.

This correction mechanism 1 includes at least one free wheel 6, such as a ball a roller, or otherwise, which is confined inside such a chamber 5, 50, and whose dimensions are arranged to allow the free wheel freedom inside chamber 5, 50, in the first relative direction of rotation of rotor 4 relative to cavity 30, and to cause it to lock on a wall of chamber 5, 50 in the second relative direction of rotation of rotor 4 relative to cavity 30.

In a variant, free wheel 6 is movable only in a plane perpendicular to pivot axis D of rotor 4.

In another variant, free wheel 6 is movable only parallel to pivot axis D of rotor 4.

In yet another variant, free wheel 6 is movable both in a plane perpendicular to pivot axis D of rotor 4 and parallel to pivot axis D of rotor 4. According to a particular feature, peripheral surface 40 of rotor 4 forms a cam in each chamber 5, in a plane perpendicular to an axis of rotation D common to output wheel set 3 and rotor 4.

According to another particular feature, peripheral surface 40 of rotor 4 forms a cam in each chamber 5, in a direction parallel to an axis of rotation D common to wheel set 3 and rotor 4.

According to yet another particular feature, peripheral surface 40 of rotor 4 forms a cam, in each chamber 5, both in a plane perpendicular to an axis of rotation D common to output wheel set 3 and rotor 4, and in a direction parallel to axis of rotation D.

Figure 5:
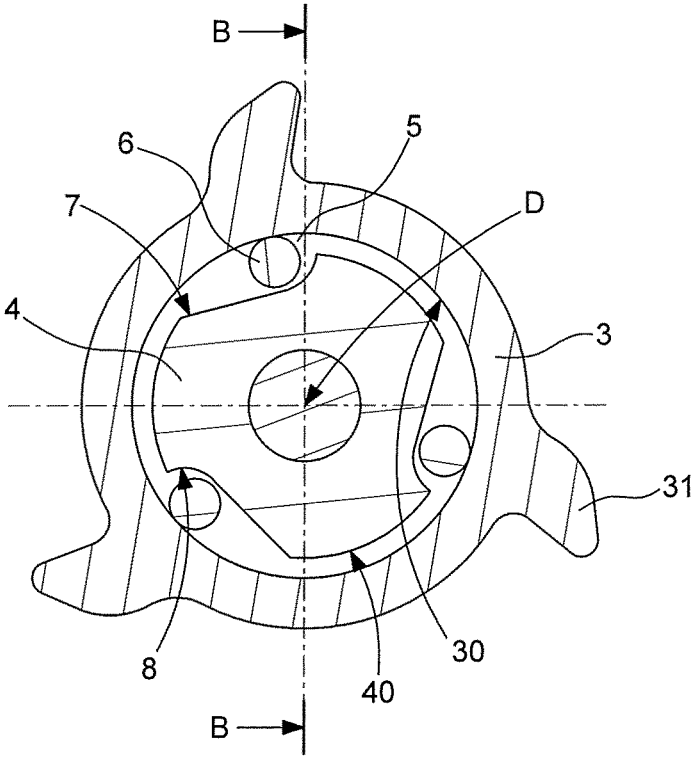
FIG. 5 is a cross-section of the free wheel mechanism in a plane perpendicular to the pivot axis of its rotor.
Figure 8:
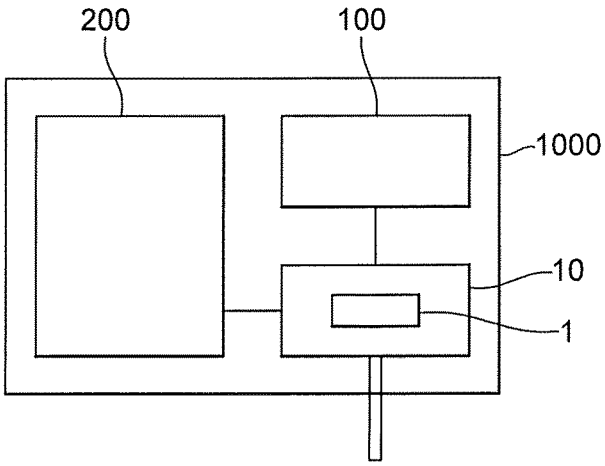
FIG. 8 is a block diagram representing a watch including a movement, a date mechanism, such a correction mechanism and a user control means.
Figure 6:
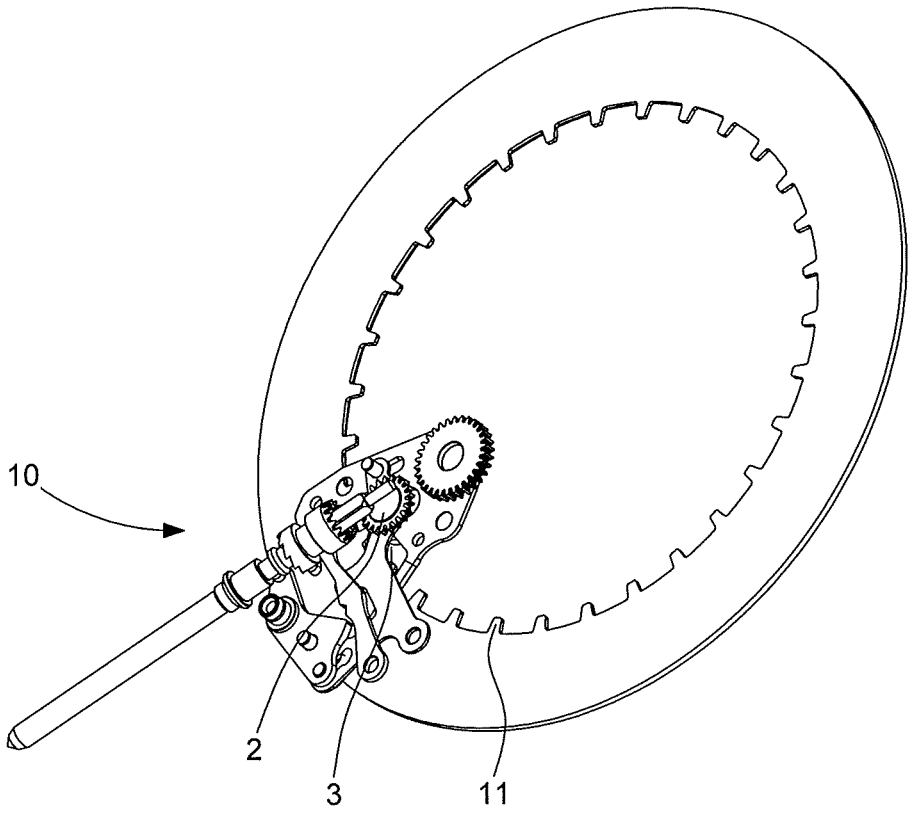
FIGS. 6 and 7 show schematic and perspective top and bottom views of a date mechanism provided with this correction mechanism.
Figure 7:
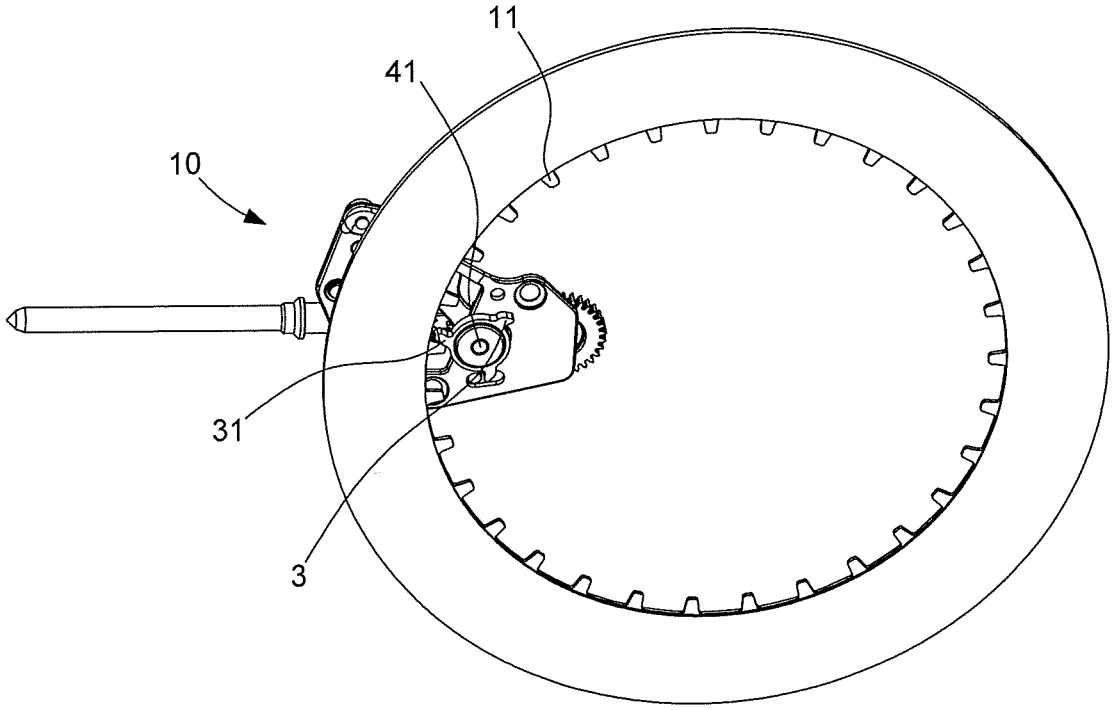

More particularly, and as seen in FIG. 5, each chamber 5, 50 includes, in the same circumferential direction as all the other chambers 5, 50, a progressive enlargement area on an inclined surface 7, followed by an enlarged area limited by a stop surface 8. Free wheel 6 is free inside the enlarged area in the first relative direction of rotation and is locked and supported on inclined surface 7 in the second relative direction of rotation.

More specifically, each free wheel 6 is a ball. In other non-illustrated variants, free wheels 6 can take other forms: locking elements that do not roll but only slide, of the wedge type, provided they can be unlocked, or geometries which are not strictly of revolution, for example idle pinions. Another variant, conversely, concerns magnetic retention of a free wheel 6, particularly a ball on one of the ball bearing cages, combined with a cam imparting a force for release and change of position: the cam is then no longer used for retention but for unlocking.

In the particular variant illustrated by the Figures, the entire system is on a same axis, the rotating motion comes through a lower pinion forming control wheel set 2, integral in rotation with rotor 4, and is transmitted by the cover by means of inclined faces forming inclined surfaces 7 and ball bearings forming free wheels 6, which lock on an upper correction pinion forming output wheel set 3. In the opposite direction, the balls are released by the inclined faces and no movement is transmitted.

According to a particular feature, control wheel set 2, output wheel set 3, rotor 4, and each free wheel 6 are made of non-magnetic material. More particularly, at least one of control wheel set 2, output wheel set 3, rotor 4 and each free wheel 6 is made of ceramic material; more particularly still, control wheel set 2, output wheel set 3, rotor 4 and each free wheel 6 are made of ceramic material.

More particularly, correction mechanism 1 includes, on output wheel set 3 or control wheel set 2, a single pivot shoulder 9, which is arranged to cooperate with a structure 90 or plate or bridge of a timepiece mechanism 100 or of a movement 200 to which correction mechanism 1 is arranged to be fixed.

The invention also concerns a date display mechanism 10 including such a display wheel set 11 and such a correction mechanism 1.

The invention also concerns a timepiece 1000 including a date display mechanism 10 comprising a display wheel set 11 and a control wheel set 2 arranged to be controlled by user action and/or by a timepiece mechanism 100 comprised in timepiece 1000, and/or by a movement 200 comprised in timepiece 1000, which includes such a correction mechanism 1, which is more particularly arranged to correct the position of display wheel set 11 in order to change the date display.

More particularly, this timepiece 1000 is a watch.

The mechanism according to the invention is a simple and compact (coaxial) system which includes a limited number of components. This mechanism has no friction system and has a fixed distance of centres.

The invention claimed is:

1. A correction mechanism for a timepiece date display mechanism, arranged to change the angular position of a display wheel set comprised in said date display mechanism, said correction mechanism comprising:

a control wheel set arranged to be controlled by user action and/or by a timepiece mechanism;

an output wheel set arranged to cooperate with said display wheel set; and a free wheel mechanism which is arranged to disengage said output wheel set from said control wheel set in a first relative direction of rotation, and to engage said output wheel set with said control wheel set in a second relative direction of rotation opposite to said first relative direction of rotation, wherein said control wheel set or respectively said output wheel set is integral in rotation with a rotor, wherein said output wheel set or respectively said control wheel set includes a cavity inside which said rotor can pivot, wherein said rotor and/or said cavity includes at least a first chamber of variable radial cross-section with respect to the pivot axis of said rotor, wherein at least one free wheel is enclosed inside said chamber, and whose dimensions are arranged to allow said free wheel freedom inside said chamber in said first relative direction of rotation of said rotor with respect to said cavity, and to cause said free wheel to lock on a wall of said chamber in said second relative direction of rotation of said rotor with respect to said cavity, and wherein said free wheel is movable only in a plane perpendicular to said pivot axis of said rotor.

2. The correction mechanism according to claim 1, wherein the peripheral surface of said rotor forms a cam in each said chamber, in a plane perpendicular to an axis of rotation common to said output wheel set and to said rotor.

3. The correction mechanism according to claim 1, wherein the peripheral surface of said rotor forms a cam in each said chamber, in a direction parallel to an axis of rotation common to said output wheel set and to said rotor.

4. The correction mechanism according to claim 1, wherein said control wheel set, said output wheel set, said rotor, and each said free wheel, are made of non-magnetic material.

5. The correction mechanism according to claim 4, wherein said control wheel set, said output wheel set, said rotor, and each said free wheel are made of ceramic material.

6. The correction mechanism according to claim 1, wherein said correction mechanism includes, in said output wheel set or said control wheel set, a single pivot shoulder arranged to cooperate with a structure or plate or bridge of a timepiece mechanism or of a movement to which said correction mechanism is arranged to be fixed.

7. A date display mechanism comprising a display wheel set and a correction mechanism according to claim 1.

8. A timepiece comprising a date display mechanism comprising a display wheel set, and a control wheel set arranged to be controlled by user action and/or by a timepiece mechanism comprised in said timepiece and/or by a movement comprised in said timepiece, which includes a correction mechanism according to claim 1, arranged to correct the position of said display wheel set to change the date display.

9. The timepiece according to claim 8, wherein the timepiece is a watch.

10. A correction mechanism for a timepiece date display mechanism, arranged to change the angular position of a display wheel set comprised in said date display mechanism, said correction mechanism comprising:

a control wheel set arranged to be controlled by user action and/or by a timepiece mechanism;

an output wheel set arranged to cooperate with said display wheel set; and a free wheel mechanism which is arranged to disengage said output wheel set from said control wheel set in a first relative direction of rotation, and to engage said output wheel set with said control wheel set in a second relative direction of rotation opposite to said first relative direction of rotation, wherein said control wheel set or respectively said output wheel set is integral in rotation with a rotor, wherein said output wheel set or respectively said control wheel set includes a cavity inside which said rotor can pivot, wherein said rotor and/or said cavity includes at least a first chamber of variable radial cross-section with respect to the pivot axis of said rotor, and wherein at least one free wheel is enclosed inside said chamber, and whose dimensions are arranged to allow said free wheel freedom inside said chamber in said first relative direction of rotation of said rotor with respect to said cavity, and to cause said free wheel to lock on a wall of said chamber in said second relative direction of rotation of said rotor with respect to said cavity, wherein said free wheel is movable both in a plane perpendicular to said pivot axis of said rotor and parallel to said pivot axis of said rotor.

11. The correction mechanism according to claim 10, wherein the peripheral surface of said rotor forms a cam in each said chamber, both in a plane perpendicular to an axis of rotation common to said output wheel set and to said rotor, and in a direction parallel to said axis of rotation.

12. A correction mechanism for a timepiece date display mechanism, arranged to change the angular position of a display wheel set comprised in said date display mechanism, said correction mechanism comprising:

a control wheel set arranged to be controlled by user action and/or by a timepiece mechanism;

an output wheel set arranged to cooperate with said display wheel set; and a free wheel mechanism which is arranged to disengage said output wheel set from said control wheel set in a first relative direction of rotation, and to engage said output wheel set with said control wheel set in a second relative direction of rotation opposite to said first relative direction of rotation, wherein said control wheel set or respectively said output wheel set is integral in rotation with a rotor, wherein said output wheel set or respectively said control wheel set includes a cavity inside which said rotor can pivot, wherein said rotor and/or said cavity includes at least a first chamber of variable radial cross-section with respect to the pivot axis of said rotor, and wherein at least one free wheel is enclosed inside said chamber, and whose dimensions are arranged to allow said free wheel freedom inside said chamber in said first relative direction of rotation of said rotor with respect to said cavity, and to cause said free wheel to lock on a wall of said chamber in said second relative direction of rotation of said rotor with respect to said cavity, wherein each said chamber includes, in the same circumferential direction as all the other said chambers, a progressive enlargement area on an inclined surface, followed by an enlarged area limited by a stop surface, and wherein said free wheel is free in said enlarged area in said first relative direction of rotation, and locked and supported on said inclined surface in said second relative direction of rotation.

13. A correction mechanism for a timepiece date display mechanism, arranged to change the angular position of a display wheel set comprised in said date display mechanism, said correction mechanism comprising:

a control wheel set arranged to be controlled by user action and/or by a timepiece mechanism;

an output wheel set arranged to cooperate with said display wheel set; and a free wheel mechanism which is arranged to disengage said output wheel set from said control wheel set in a first relative direction of rotation, and to engage said output wheel set with said control wheel set in a second relative direction of rotation opposite to said first relative direction of rotation, wherein said control wheel set or respectively said output wheel set is integral in rotation with a rotor, wherein said output wheel set or respectively said control wheel set includes a cavity inside which said rotor can pivot, wherein said rotor and/or said cavity includes at least a first chamber of variable radial cross-section with respect to the pivot axis of said rotor, and wherein at least one free wheel is enclosed inside said chamber, and whose dimensions are arranged to allow said free wheel freedom inside said chamber in said first relative direction of rotation of said rotor with respect to said cavity, and to cause said free wheel to lock on a wall of said chamber in said second relative direction of rotation of said rotor with respect to said cavity, wherein said free wheel is a ball.

* * * * *